US006913512B2

(12) United States Patent
Grivna

(10) Patent No.: US 6,913,512 B2
(45) Date of Patent: Jul. 5, 2005

(54) MATERIAL REMOVAL MONITOR

(76) Inventor: Howard W. Grivna, 12607 - 74th Ave. North, Maple Grove, MN (US) 55369

( * ) Notice: Subject to any disclaimer, the term of this patent is extended or adjusted under 35 U.S.C. 154(b) by 0 days.

(21) Appl. No.: 10/863,154

(22) Filed: Jun. 7, 2004

(65) Prior Publication Data

US 2004/0235391 A1 Nov. 25, 2004

Related U.S. Application Data

(63) Continuation-in-part of application No. 10/225,330, filed on Aug. 21, 2002, now Pat. No. 6,769,958.

(51) Int. Cl.[7] ..... B24B 49/00

(52) U.S. Cl. ..... 451/5; 451/8; 451/9; 451/10; 451/300; 451/296

(58) Field of Search ..... 451/5, 8, 9, 10, 451/300, 303, 299, 296

(56) References Cited

U.S. PATENT DOCUMENTS

| | | | |
|---|---|---|---|
| 3,675,375 | A | 7/1972 | Enabnit et al. |
| 3,782,044 | A | 1/1974 | Olin |
| 3,832,808 | A | 9/1974 | Kiser |
| 3,895,464 | A | 7/1975 | Kiser |
| 3,908,316 | A | 9/1975 | Rettew |
| 4,513,539 | A | 4/1985 | Steinback |
| 4,546,572 | A | 10/1985 | Fischer |
| 4,594,815 | A | 6/1986 | Mickelson et al. |
| 4,621,459 | A | 11/1986 | Stump et al. |
| 4,630,407 | A | 12/1986 | Rhodes |
| 5,052,452 | A | 10/1991 | Goenner |
| 5,193,314 | A | 3/1993 | Wormley et al. |
| 5,396,938 | A | 3/1995 | Cannaday |
| 6,102,781 | A | 8/2000 | Greathouse et al. |
| 6,234,871 | B1 | 5/2001 | Chaloupek et al. |

FOREIGN PATENT DOCUMENTS

| | | |
|---|---|---|
| EP | 0 484 303 A1 | 5/1992 |

*Primary Examiner*—M. Rachuba
(74) *Attorney, Agent, or Firm*—Haugen Law Firm PLLP

(57) ABSTRACT

A material removal optimizing system for a wood surface treating apparatus with a plurality of individual work stations arranged serially along an endless conveyor. Each station includes a working abrasive head along with an elevation adjustment mechanism for adjustably positioning the contact surface of each abrasive head at a desired working distance from the opposed surface of the workpiece traveling along the endless conveyor. An incoming workpiece dimension indicator is positioned at the infeed end, and additional workpiece dimension indicators are positioned downstream from each work station, with each dimension indicator being positioned to measure the dimensional deviation of the workpiece from a datum plane after it has passed through its preceding individual work station.

3 Claims, 3 Drawing Sheets

MATERIAL REMOVAL MONITOR

CROSS-REFERENCE TO RELATED APPLICATION

The present application is a continuation-in-part of our application Ser. No. 10/225,330, filed Aug. 21, 2002 now U.S. Pat. No. 6,769,958, entitled "MATERIAL REMOVAL MONITOR", the content of which is incorporated herein in its entirety.

BACKGROUND OF THE INVENTION

The present invention relates generally to an improved apparatus and system for monitoring and controlling the operation of individual work stations within a sanding system having a plurality of such stations functioning in combination with a continuous feed system such as an endless conveyor belt or roll feed. Other continuous feed systems, such as reciprocating systems or rotary feed systems are applicable. Such systems are in wide use today, and typically employ abrasive workpiece surfacing heads, such as drum heads and platen heads. These heads are arranged serially adjacent to and typically elevated from the surface of the conveyor, and treat the workpieces as they move along the conveyor between individual working stations disposed adjacent to the belt path. The present invention may be characterized as one wherein the stock removal occurring in individual work stations is carefully monitored, and wherein the quantity or magnitude of stock removal is referenced or indexed from the individual workpieces.

In sanding systems of the type described, proper working head adjustment is essential to maintain proper material removal targets preserve and extend the lifetime of the abrasive belts, and reduce and/or maintain proper power consumption. The systems also preserve the quality of finish (scratch removal) on the finished work. In this connection, the useful life of an individual belt within the multi-station system may be extended through proper and continuous monitoring of head elevation, thereby controlling the amount of stock removal at each station. A workpiece typically enters the system and is initially contacted and abraded by a coarse abrasive belt operating in the initial or first work station. Most of the stock removal occurs in the coarser stations, with later stations being typically and primarily employed for scratch removal and finish quality improvement. In order to preserve the quality and extend the lifetime of the relatively fine grit abrasive belts, care must be taken so as to avoid exceeding the removal capability of the finer grit belts. When care is taken to assure adequate stock removal at the early station or stations, the belt life of the subsequent fine-grit stations is substantially extended. Consistent with these objectives, care is taken to monitor the amount of material removal at each station along the continuous feed mechanism. More particularly, the datum plane for workpiece comparison purposes is that thickness targeted for workpieces as they exit the final work station in the series.

As abrasive belts constantly experience wear, care must be taken to reposition or adjust the working height of each working abrasive head in order to continuously maintain proper system balance and operation. Being subject to more aggressive action, abrasive belts with coarse grit tend to change caliper more rapidly than the finer belts, and hence constant or at least frequent adjustment of the stock removal heads is essential. Furthermore, as the abrasive belts employing finer grit change caliper or otherwise experience wear, they too must be adjustably positioned so as to maintain consistent and proper stock and accordingly scratch removal.

An additional cause of uneven belt wear and/or uneven sanding performance is in the tendency for wide-belt sanding heads to fall out of planar parallel relationship with the plane defined by the workpiece conveyor. For example, one or more of the sanding heads may, over time, displace out of parallel relationship with the workpiece conveyor top surface, thereby causing one side of the sanding belt to come into contact with the workpiece more heavily than a second laterally opposed side of the sanding belt. Such a situation results in uneven sanding of the workpiece, as well as uneven wear upon the sanding belt.

Whenever replacement of an abrasive belt is indicated, it is necessary to shut the entire machine operation down and undertake such replacement as required. Inasmuch as the abrasive belts with the finer grits are highly susceptible to damage from running in an overload condition, frequency of belt replacement may be minimized if care is taken to assure that adequate stock removal occurs at the coarse-grit station or stations. In other words, by maintaining adequate and proper stock removal at the appropriate working station, belt wear for the scratch removal stations is substantially reduced and optimum system performance and workpiece quality are maintained.

SUMMARY OF THE INVENTION

In accordance with the present invention, a wood surface treating system and apparatus is provided which comprises a plurality of individual work stations arranged serially along and between infeed (material removal) and outfeed (finishing stations) or ends of an endless conveyor or other continuous feed system. The work stations are arranged with the stock removal station being disposed adjacent to the infeed end, with scratch removal stations being disposed adjacent and downstream from the outfeed end. Each station includes a working abrasive head, a workpiece dimension indicator, and head positioning means for adjustably positioning the work contacting surface of each abrasive head at a predetermined desired working distance measured from the top surface of the finished workpiece as a datum plane. In operation, and for virtually all varieties of wood, at least about 60% or 70% of the stock removal occurs at the initial work station, which is fitted with an abrasive belt having relatively coarse grit. At the subsequent or scratch removal stations, the abrasive belts are positioned for only that modest stock removal which is occasioned by exposure to the coarser grit employed in the upstream station. Thus, subsequent work stations have primary emphasis on scratch removal, with consistent and/or persistent readjustment of individual working heads being undertaken in order to preserve machine operation and optimize workpiece surface quality. This is all occasioned because of machine operation dynamics, with the immediate state of work stations undergoing constant change during operation.

The infeed end of the system and along with each of the work stations is provided with a workpiece dimension indicator. The infeed dimension indicator is employed to reject or eliminate workpieces which are not within the nominal size range. The remaining dimension indicators are positioned to measure a deviation dimension from the datum plane as they leave an individual work station. The dimension indicators comprise dimension responsive detector means for generating a signal responsive to the deviation from datum plane being measured for each workpiece. Accordingly, the extent of stock removal achieved on each workpiece is readily determined. The information obtained from the dimension responsive detector means may be utilized by a system operator to adjustably position the working heads to maintain proper stock removal while machine operation continues.

Each of the heads is provided with a head elevation adjustment mechanism that is adapted to vertically adjust the position of the respective abrasive head relative to the conveyor top surface. Such adjustment mechanisms are typically in the form of cams which, when actuated, change the positioning of the sanding head relative to the conveyor.

A central processor and memory may be provided for the system, with this processor being in communication with each of the individual dimension indicators and head elevation control means. In addition to receiving inputs from each of the individual indicators, the central processor has further inputs for other operating parameters including belt speed, conveyor speed, optimum target material removal and wood type. The central processor is desirable inasmuch as sanding results from a system as described herein are dynamic rather than static, and for that reason, substantially continuous adjustments are appropriate. By way of example, it has been found that the thickness of abrasive belts changes dramatically with wear, and it accordingly becomes important to measure stock removal from each sanding head to insure that subsequent heads are not required to exceed their normal removal capability.

Another parameter affecting belt wear arises due to the different coarseness of the grit along with various types of backing materials being employed, such as, for example, film, paper, cloth, and the like. Whenever possible, it is desirable to select one type of belt for each of the various heads involved in the operation.

Feed speed is a parameter affecting overall system operation. Slower conveyor feed speeds permit each belt to remove more material or stock from the workpiece and thereby minimize belt loading which may ultimately contribute to streaking. Inasmuch as abrasive belt speed is generally fixed, belt loading may be advantageously controlled through monitoring of feed speed.

Therefore, it is a primary object of the present invention to provide an improved apparatus and system for abrasive treatment of wood surfaces, with the improved system comprising a plurality of individual serially arranged work stations and workpiece dimension indicators for directly providing to the system operator dimensional deviation from datum plane information for maintaining optimum stock removal and scratch control.

It is another object of the present invention to provide an improved apparatus and system for abrasive treatment of wood surfaces, with the system utilizing a method for directly indicating to the user the amount of stock removal performed at one or more locations across the width of the workpiece subsequent to each material removal station of the system.

Other and further objects of the present invention will become apparent to those skilled in the art upon a study of the following specification, appended claims, and accompanying drawings.

DETAILED DESCRIPTION OF THE PREFERRED EMBODIMENT

The objects and advantages enumerated above together with other objects, features, and advances represented by the present invention will now be presented in terms of detailed embodiments described with reference to the attached drawing figures which are intended to be representative of various possible configurations of the invention. Other embodiments and aspects of the invention are recognized as being within the grasp of those having ordinary skill in the art.

Figure 1:
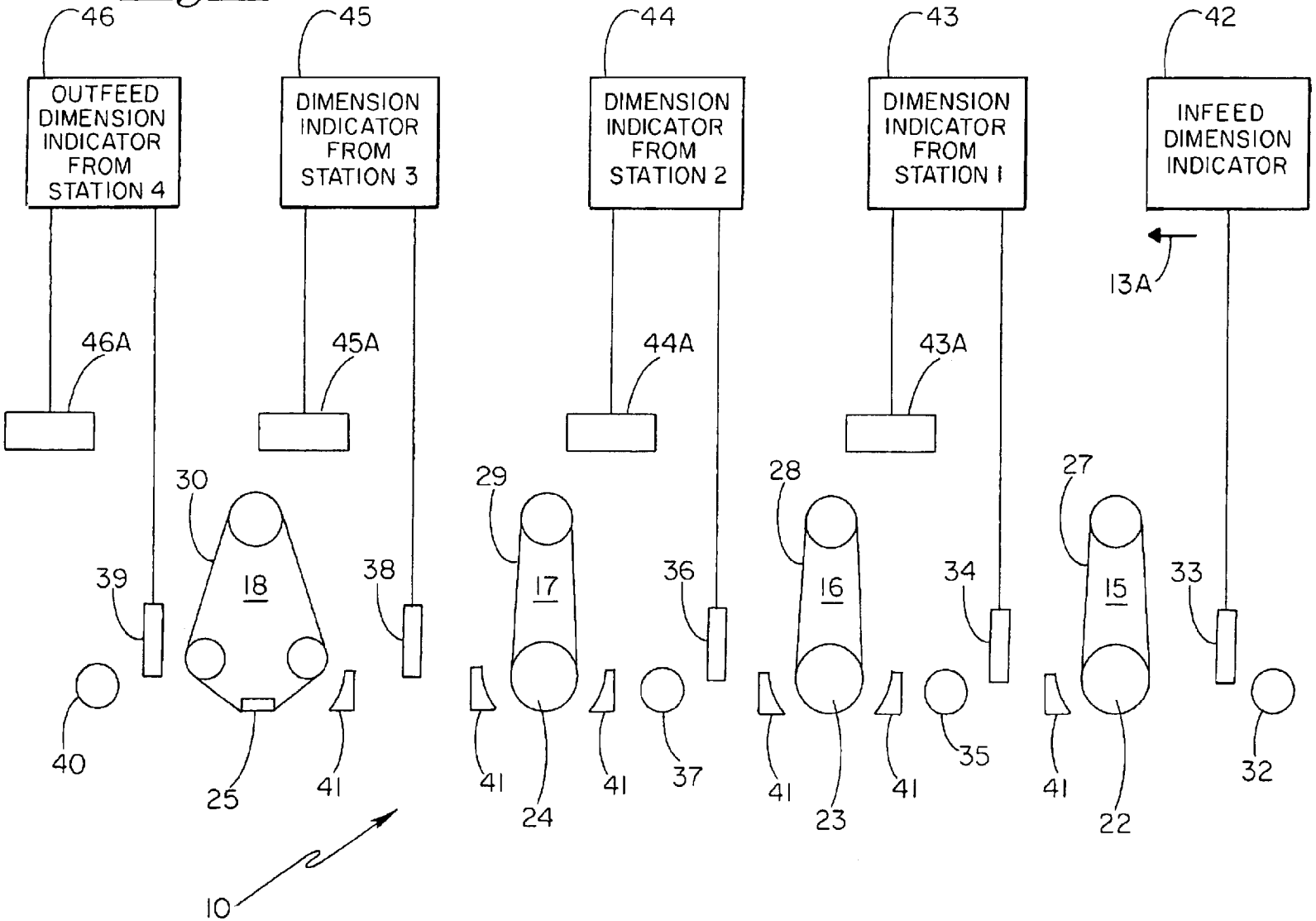
FIG. 1 is a side elevational view of a typical wood surface treating system in accordance with the present invention with the conveyor removed and further illustrating schematically the arrangement of the individual devices or components of the system.
Figure 2:
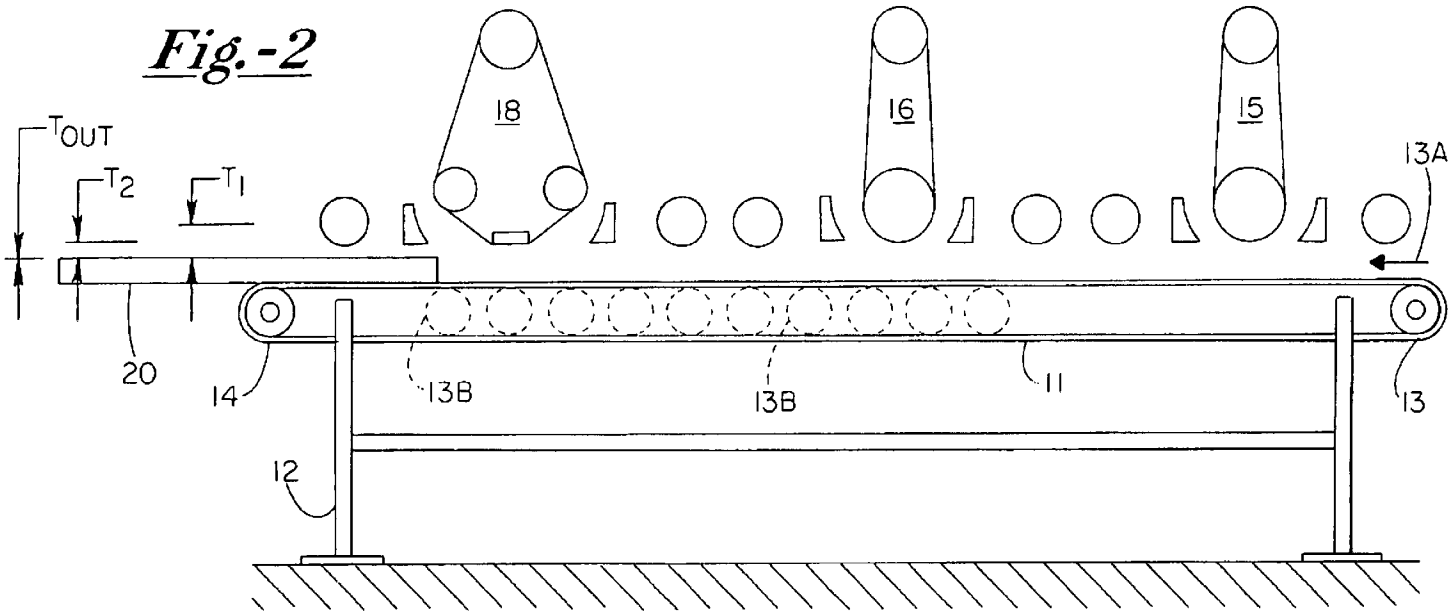
FIG. 2 is a view similar to FIG. 1, and further illustrating an endless conveyor disposed in working relationship to the serial arrangement of a pair of working stations, and further illustrating a workpiece, shown in section, following treatment in the system and incorporating a series of dimensional changes representing stock removal at individual stations along the system.
Figure 3:
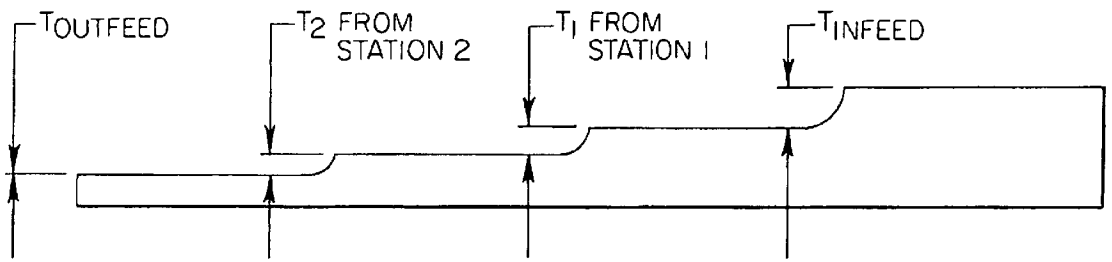
FIG. 3 is a demonstrative side view illustrating the changes in thickness dimension occurring on a workpiece as it passes through a system in accordance with the present invention.

In accordance with the preferred embodiment of the present invention, and with attention being directed to FIGS. 1 and 2 of the drawings, the sanding system generally designated 10 comprises an endless conveyor 11 supported on frame means 12 and having infeed and outfeed ends 13 and 14 respectively, supports a plurality of work stations including work stations generally designated 15, 16, 17 and 18. Conveyor 11 is adapted to receive a flow of workpieces at infeed end 13 and transport the workpieces through the array of work stations for delivery from the system at outfeed end 14. A typical workpiece is illustrated demonstratively at 20. Each of the individual working stations comprises a working abrasive head such as at 22, 23, 24 and 25. Endless abrasive belts are tracked and carried in each of the work stations such as at 27, 28, 29 and 30. Means are provided to position the working abrasive heads relative to the upper surface of the endless belt carried on conveyor 11 including, as is known in the art, a coarse adjustment along with a fine adjustment. Fine adjustments typically employ one or more camming members which are utilized to carefully adjust the spacing between contact points across the width of each working abrasive head and the surface of the workpiece. Inasmuch as these elevation control mechanisms are used in the art and well known to those of skill, a detailed explanation is not necessary. With reference to FIG. 2 of the drawings, it is noted that only two drum head stations are shown, specifically working stations 15 and 16, along with platen head working station 18, with working station 17 being deleted from FIG. 2 for purposes of simplification.

In order to carry the individual workpieces through the system, conventional pinch rolls are provided as at 32, 33, 34, 35, 36, 37, 38, 39 and 40. In addition, conventional hold-down shoes are provided for the system as at 41—41. In order to transport a workpiece through the system, workpieces are loaded on at the infeed end, and pass through each work station on the conveyor 11, with movement being controlled by individual pinch rolls 32–40 inclusive. Such mechanisms are conventional and known in the art.

Dimension Indicators

Each of the working stations in addition to the infeed station is provided with a dimension indicator. An infeed workpiece dimension detector is shown generally at 42, with individual dimension indicators for each station being shown generally at 43, 44, 45 and 46. Functioning integrally with the infeed dimension detector is a mechanism for alerting the operator to remove any workpiece which falls reasonably outside of the nominal dimension for which the system has been set. Such alerting and/or removal means are known in the art.

Turning now to the individual dimension indicators, indicator 43 is provided with a dimension detector as at 43A, with similar detectors being provided for downstream indicators such as at 44A, 45A and 46A. Dimension detectors which may be applied to the systems of the present invention include those making actual physical contact with the workpiece as well as those which work without actual contact. These means include disc sensors, roll sensors, as well as those detectors actuated by ultrasonic and/or light (laser) beams. Each detector is in functional communication with its dimension indicator, and is adapted to respond with a signal, analog or digital, representative of the dimensional deviation from the datum plane of the workpiece passing thereunder. In this connection, the dimensional deviation from the datum plane of each individual workpiece is accurately measured and the signal transmitted from the detector to the indicator. This system provides, therefore, an accurate indication of the stock removal occurring on and within each individual working station, and hence is representative of the amount of stock removal occurring on a piece-by-piece basis.

A particular method for determining and monitoring the performance characteristics of sanding system 10, and specifically the material removal performance of each of the working abrasive heads 22–25, includes first defining a calibrating datum plane within system 10 by feeding a first calibrating workpiece through system 10. The thickness of the treated first calibrating workpiece is then measured to insure that the treated first calibrating workpiece has a thickness dimension equal to a predetermined target outfeed thickness, with the thickness dimension of the treated first calibrating workpiece thereby defining a datum plane.

The operation of abrasive heads 22–25 are then halted so that the first calibrating workpiece may be inserted into system 10 to an extent sufficient to position a portion of the first calibrating workpiece at each of the dimension indicators 43–46 in such a manner so as each of the dimension indicators 43–46 operably indicate the thickness of the first calibrating workpiece. At this juncture, each of the dimension indicators 43–46 are manually set to a zero point or a zero reading, such that each of the dimension indicators 43–46 indicate a dimension of "0.0" while the first calibrating workpiece is positioned thereunder.

The first calibrating workpiece is then removed from system 10, and abrasive heads 22–25 are re-started in preparation for the normal operating flow of workpieces therethrough. Dimension indicators 43–46 are then observed by a system operator to compare values displayed by dimension indicators 43–46 to predetermined target total material removal amounts by ones of workstations 16, 17, and/or 18 positioned downstream from respective dimension indicators 43, 44, or 45. Since respective dimension indicators 43–46, in the preferred method, visually indicate the dimensional deviation between a respective workpiece being operably monitored and the datum plane, each dimension indicator 43–46 displays a value that is equal to the amount of material still to be removed by the downstream workstations 16, 17, and/or 18. By consequence, such a displayed value further indicates to the system operator the amount of material that has been removed by the respective immediately upstream abrasive head 22, 23, 24, or 25.

As described above, it is a particular object of the present invention to monitor the sanding performance of each abrasive head 22–25 so that pre-defined loads and, therefore, material removal at each of abrasive head 22–25 is maintained at a predetermined level. Such maintenance of a predetermined material removal amount at each of abrasive heads 22–25 significantly enhances both life of respective sanding belts and final product quality.

To assist the system operator in monitoring the performance of each workstation 15–18, predetermined target total material removal amounts that remain to be taken from respective downstream workstations 23, 24, and/or 25 are provided to the system operator in order to compare to real-time values displayed by respective ones of dimension indicators 43–46. Such a comparison capability provides immediate feedback to the system operator as to the individual performance of each of workstations 15–18 of system 10.

By way of example, a particular system 10 may be prepared as described above to remove 0.025 inches of material from workpieces passing therethrough. The following settings for material removal may be assigned to each of workstations 15–18:

| Workstation No. | Material Removal (inches) |
|---|---|
| 15 | 0.010 |
| 16 | 0.008 |
| 17 | 0.005 |
| 18 | 0.002 |

In accordance with the above settings, the target total material removal amounts by respective workstations 16, 17, and/or 18 positioned downstream from respective dimension indicators 43–46 are as follows:

| Dimension indicator | Target Display Value (inches) |
|---|---|
| 43 | 0.015 |
| 44 | 0.007 |
| 45 | 0.002 |
| 46 | 0.000 |

The target display values identified above represent the predetermined target total material removal amount to be undertaken by the workstations positioned downstream from the respective dimension indicator. As such, if dimension indicator 43 indicates a value either less than or greater than 0.015 inches, the system operator immediately recognizes that workstation 15 is not removing a targeted amount of material. Therefore, the system operator knows to change the vertical position of abrasive head 22 with respect to conveyor 11 in an amount equal to the deviation between the value indicated by dimension indicator 43 and the predetermined value of 0.015 inches. Similar monitoring and adjustments are conducted for downstream dimension indicators and abrasive heads.

Through the methodology of the present invention, therefore, the system operator may observe, in real time deviations in performance characteristics at each individual workstation. In doing so, the operator is made aware in real time of where adjustments to system 10 are needed in order to maintain pre-defined performance at each workstation 15–18, as well as final overall thickness and finish of the respective workpieces.

Figure 4:
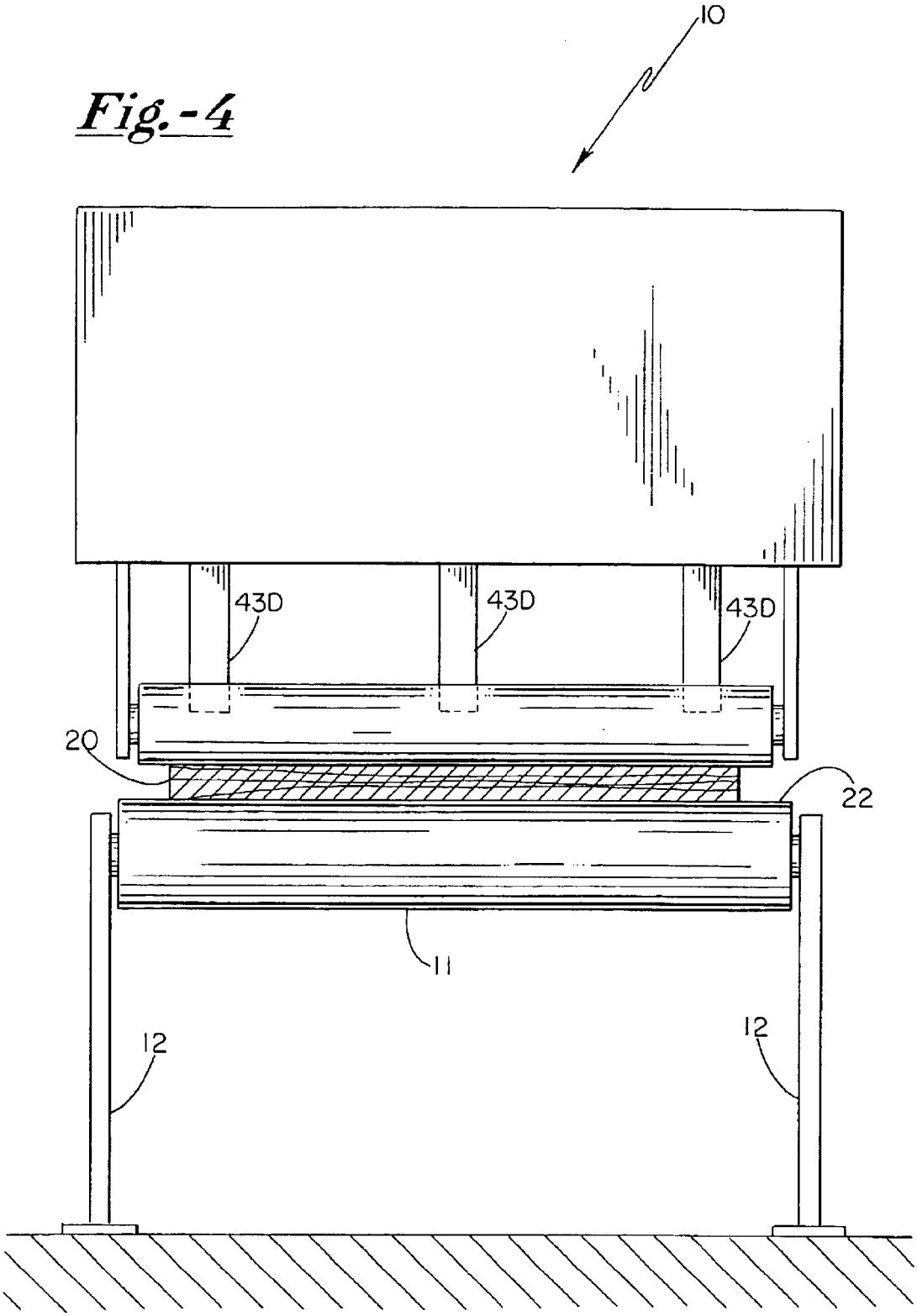
FIG. 4 is an end elevational view of the wood surface treating system illustrated in FIG. 1.

In some embodiments of the present invention, and as illustrated in FIG. 4, a plurality of dimension indicators 43D may be positioned across the width of system 10 at a location downstream from workstation 15 having abrasive head 22. Likewise, a plurality of dimension indicators 44D, 45D, and 46D may be similarly positioned across the width of system 10. Such an array of dimension indicators further assists the system operator in determining whether each respective upstream abrasive head 22–25 is operating in a plane parallel to conveyor 11. It has been found by the Applicant that abrasive heads 22–25 may, over time, fail to maintain a substantially parallel relationship with conveyor 11. As a result, portions of respective abrasive heads 22–25 undergo a more severe load in the sanding operation than other portions thereof. Such an uneven load results in uneven sanding of the workpiece, as well as uneven wear on the respective sanding belts. The use of a system 10 incorporating a plurality of dimension indicators disposed along the width of workpiece exposure to workstations 15–19 enables visual feedback by the operator of whether each individual workstation 15–18 is operating evenly across its entire width. In the event that a discrepancy is revealed among respective dimension indicators 43D, 44D, 45D, or 46D, adjustments may be made to respective portions of the out-of-alignment abrasive heads 15–18 in order to correct any non-planar sanding.

Typical Application

In a typical application for finishing flat surfaces, such as wooden doors or the like, the following table provides representative information regarding operational parameters:

Example I

| | Head 18 | Head 17 | Head 16 | Head 15 | Total |
|---|---|---|---|---|---|
| Head location | Top | Top | Top | Top | |
| Head type | Platen | Drum | Drum | Drum | |
| Drum hardness | — | 55 duro. | 65 duro. | 75 duro. | |
| Conveyor belt = wedge grip, vacuum type | | | | | |
| Feed speed = 18.5 FPM | | | | | |
| Belt size = 52" × 103" | | | | | |
| Grit sequence | 220 grit | 180 grit | 150 grit | 100 grit | |
| Approx. depth of scratch | .002" | .004" | .005" | .010" | |
| Maximum removal capability at 18.5 FPM | | | | | |
| Hard maple | .0015" | .005" | .009" | .0215" | .0355" |
| Target removal | — | — | — | — | .037" |
| Cherry | .0015" | .005" | .010" | .022" | 0.385" |
| Hickory oak | .002" | .006" | .012" | .027" | .047" |

Example I provides an indication of the parameters useful in stock removal for a fine finish on hard maple. The system operator may be provided with predetermined information indicative of the type of wood in the workpiece, as well as parameters including grit utilized at each station, belt speed, and conveyor speed.

Example II

| | Head 18 | Head 16 | Head 15 | Total |
|---|---|---|---|---|
| Head location | Top | Top | Top | |
| Head type | Platen | Drum | Drum | |
| Drum hardness | — | 65 duro. | 75 duro. | |
| Conveyor belt = tan rough top (not dressed) | | | | |
| Feed speed = 48 FPM | | | | |
| Belt size = 52" × 103" | | | | |
| Grit sequence | 180 grit | 150 grit | 100 grit | |
| Approx. depth of scratch | .002" | .005" | .010" | |
| Maximum removal per head at 48 FPM | | | | |
| Hard maple | .001" | .003" | .008" | .012" |
| Cherry | .001" | .003" | .009" | .013" |
| Maximum removal per head at 20 FPM | .003" | .008" | .019" | .030" |
| Hard maple | .003" | .008" | .019" | .030" |
| Cherry | .003" | .009" | .020" | .032" |
| Maximum removal per head at 48 FPM | | | | |
| Maple, hickory, ash, oak | .002" | .004" | .010" | .016" |
| Poplar | .003" | .006" | .014" | .023" |
| Pine | .004" | .008" | .017" | .029 |

It will be appreciated that the examples and apparatus given herein are provided for illustration purposes only, and are not to be construed as a limitation upon the scope to which the present invention is reasonably entitled.

The invention has been described herein in considerable detail in order to comply with the patent statutes, and to provide those skilled in the art with the information needed to apply the novel principles and to construct and use embodiments of the invention as required. However, it is to be understood that the invention can be carried out by specifically different devices and that various modifications can be accomplished without departing from the scope of the invention itself.

What is claimed is:

1. A method for determining and monitoring material removal performance in a wood surface treating apparatus comprising an array of individual workstations arranged serially along and between infeed and outfeed ends of an endless conveyor, said wood surface treating apparatus further including:

frame means operably supporting said endless conveyor and said array of workstations;

said endless conveyor being adapted to receive a flow of workpieces at said infeed end and to firmly support and transport said flow of workpieces through said array of workstations for delivery to said outfeed end;

said array of workstations comprising at least first and second workstations, with each workstation comprising a working abrasive head and head elevation adjustment means for adjustably positioning the work contacting surface of each abrasive head at a predetermined desired working distance from the opposed surface of said endless conveyor, with the working abrasive head of said first workstation having a relatively coarse abrasive disposed thereon for abrasively removing a predetermined amount of stock from the exposed surface of each workpiece being transported by said conveyor;

said second workstation being disposed downstream from said first workstation with a relatively fine abrasive disposed thereon for removal of a further predetermined amount of stock from each workpiece;

a plurality of dimension indicators positioned in spaced relationship along said conveyor, each indicator having a dimension responsive detector means for generating a signal responsive to the dimension of each workpiece at spaced points along said endless conveyor, including an outfeed dimension indicator at the outfeed end of said conveyor, and an intermediate dimension indicator positioned between each mutually adjacent pair of workstations for determining the extent of stock removal from each workpiece being transported from the upstream station of each pair of workstations;

said method comprising:

(a) feeding a first calibrating workpiece through said wood surface treating apparatus;

(b) measuring the thickness of the treated first calibrating workpiece to insure that said first calibrating workpiece has a thickness dimension equal to a predetermined target outfeed thickness, the thickness dimension of said treated first workpiece defining a datum plane;

(c) halting the operation of said abrasive heads;

(d) inserting said first calibrating workpiece into said wood surface treating apparatus to an extent sufficient to position a portion of said first calibrating workpiece at each of said plurality of dimension indicators;

(e) setting each of said dimension indicators to a zero reading;

(f) removing said first calibrating workpiece from said wood surface treating apparatus;

(g) re-starting the operation of said abrasive heads; and (h) monitoring said dimension indicators during said flow of workpieces, and comparing values displayed by said dimension indicators to predetermined target total material removal amounts by ones of said workstations positioned downstream from respective said dimension indicators, which displayed values indicate the dimensional deviation between a respective workpiece being operably monitored and said datum plane.

2. A method as in claim 1, further including adjusting the elevation of respective said abrasive heads relative to said endless conveyor in an amount substantially equal to respective dimensional deviation amounts from the predetermined target total material removal amounts by respective downstream workstations.

3. A method as in claim 1, further including adjusting the elevation of respective portions of said abrasive heads relative to said endless conveyor in an amount substantially equal to respective dimensional deviation amounts from the predetermined target total material removal amounts by respective downstream workstations.

* * * * *